US011786797B2

(12) United States Patent
Rozo et al.

(10) Patent No.: US 11,786,797 B2
(45) Date of Patent: Oct. 17, 2023

(54) EXERCISE DEVICE ROTATING DISPLAY MECHANISM SYSTEMS AND METHODS

(71) Applicant: Peloton Interactive, Inc., New York, NY (US)

(72) Inventors: Nicolas Rozo, Brooklyn, NY (US); Sam Patterson, New York, NY (US)

(73) Assignee: Peloton Interactive, Inc., New York, NY (US)

( * ) Notice: Subject to any disclaimer, the term of this patent is extended or adjusted under 35 U.S.C. 154(b) by 503 days.

(21) Appl. No.: 16/933,961

(22) Filed: Jul. 20, 2020

(65) Prior Publication Data

US 2022/0016511 A1 Jan. 20, 2022

(51) Int. Cl.

*A63B 71/06* (2006.01)
*A63B 21/00* (2006.01)
*A63B 22/06* (2006.01)

(52) U.S. Cl.

CPC ..... *A63B 71/0619* (2013.01); *A63B 21/4035* (2015.10); *A63B 22/0605* (2013.01); *A63B 2071/0658* (2013.01)

(58) Field of Classification Search

CPC ..... A63B 21/4035; A63B 22/0605; A63B 71/0619; A63B 2022/0611; A63B 2022/0617; A63B 2022/0623; A63B 2022/0629; A63B 2022/0635; A63B 2022/0641; A63B 2022/0647; A63B 2022/0652; A63B 2022/0658

See application file for complete search history.

(56) References Cited

U.S. PATENT DOCUMENTS

| | | | | |
|---|---|---|---|---|
| 4,976,424 | A * | 12/1990 | Sargeant | A63B 21/0053 482/3 |
| 6,505,988 | B1 | 1/2003 | Oddsen | |
| 7,445,583 | B2 * | 11/2008 | Chen | A63B 71/0622 D8/380 |
| 8,764,609 | B1 * | 7/2014 | Elahmadie | A63B 23/0211 482/57 |
| 8,876,661 | B2 * | 11/2014 | Lu | A63B 71/0619 482/904 |
| 10,500,473 | B2 * | 12/2019 | Watterson | A63B 22/0023 |
| 2006/0058163 | A1 * | 3/2006 | Matsumoto | A63B 22/0605 482/57 |
| 2008/0093517 | A1 * | 4/2008 | Chen | A63B 22/0605 482/57 |

(Continued)

*Primary Examiner* — Joshua Lee

(74) *Attorney, Agent, or Firm* — Haynes and Boone, LLP

(57) ABSTRACT

An exercise device rotating display mechanism is described herein. An exercise device may include a handlebar and a rotating mechanism. At least a portion of the rotating mechanism may be rotatable relative to the handlebar to pan the rotating mechanism left and right relative to the handlebar. The rotating mechanism may include a pivot including a stop, a display mount rotatably connected to the pivot, and a tab associated with the display mount and configured to engage the stop of the pivot with rotation of the display mount relative to the pivot to define at least one stop position of the rotating mechanism. The rotating mechanism may be connected to a support arm extending from the handlebar. A display may be connected to the rotating mechanism, such that panning of the rotating mechanism positions the display in one of a plurality of positions relative to the handlebar.

20 Claims, 10 Drawing Sheets

(56) References Cited

U.S. PATENT DOCUMENTS

| | | | | |
|---|---|---|---|---|
| 2008/0113853 | A1* | 5/2008 | Jang | A61H 1/0222 482/142 |
| 2010/0077564 | A1* | 4/2010 | Saier | A63B 22/0605 16/242 |
| 2013/0102440 | A1* | 4/2013 | Hutchins | A63B 21/0023 482/8 |
| 2016/0258573 | A1 | 9/2016 | Goldish et al. | |
| 2020/0238130 | A1* | 7/2020 | Silcock | A63B 22/0605 |

* cited by examiner

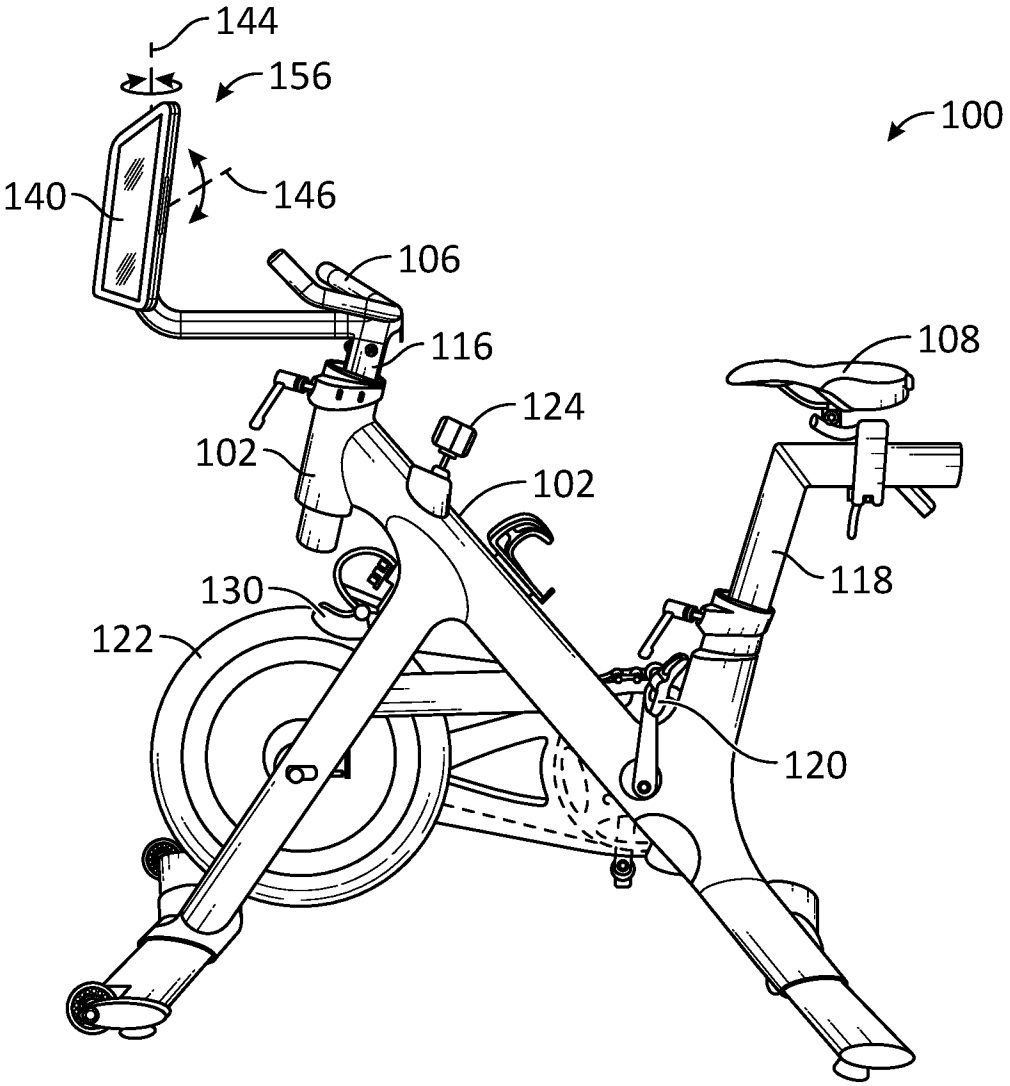
FIG. 7
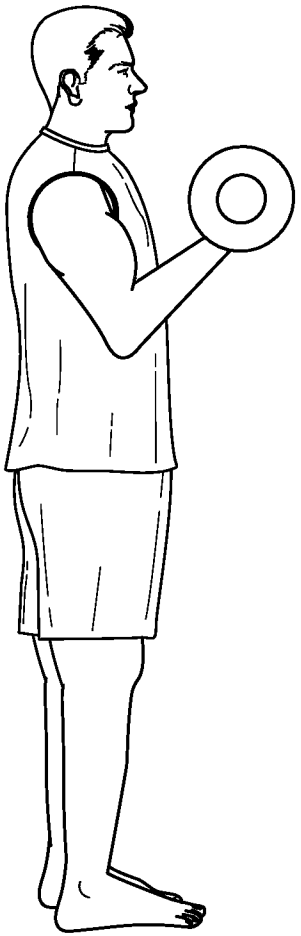

EXERCISE DEVICE ROTATING DISPLAY MECHANISM SYSTEMS AND METHODS

TECHNICAL FIELD

One or more embodiments relate generally to exercise equipment and, more particularly, to systems and methods for providing a rotating display mechanism of an exercise device.

BACKGROUND

Exercise devices, such as exercise bikes, treadmills, ellipticals, rowers, and the like, often include a display configured to render information to a user during exercise. For example, the display may render workout information, video streams, on-demand workouts, performance metrics, etc. Some workouts require participants to perform one or more exercises on the exercise device and one or more exercises off the exercise device. Users may also be able to access or view on the display one or more workouts unrelated to the exercise device, such as weight lifting workouts, yoga, or other floor exercises. Because the display is oriented for exercise using the exercise device, it may be difficult to view the display when performing exercises off the exercise device.

Therefore, there is a need in the art for systems and methods that address the deficiencies noted above, other deficiencies known in the industry, or at least offers an alternative to current techniques. For example, improvements are needed to allow rotation of a display of an exercise device between positions to place the display within a viewing area of a user while using the exercise device and within a viewing area of the user while performing one or more exercises off the exercise device.

SUMMARY

Systems and methods are provided for a rotating display mechanism of an exercise device. According to one or more embodiments of the present disclosure, an exercise device is provided. The exercise device may include a handlebar, a support arm extending from the handlebar, a rotating mechanism connected to the support arm, and a display connected to the rotating mechanism. At least a portion of the rotating mechanism may be rotatable relative to the handlebar to pan the rotating mechanism left and right relative to the handlebar. Panning of the rotating mechanism may position the display in one of a plurality of positions relative to the handlebar.

According to one or more embodiments of the present disclosure, a rotating mechanism for rotatably connecting a display to a handlebar of an exercise device is provided. The rotating mechanism may include a pivot, a display mount connected to the pivot, and a tab indexed with the display mount. The pivot may include a base, a shaft extending from the base, and a stop. The display mount may be connected to the pivot to rotate about the shaft. The tab may be configured to engage the stop of the pivot with rotation of the display mount about the shaft to define at least one stop position of the rotating mechanism.

According to one or more embodiments of the present disclosure, a method of assembling a rotating mechanism for an exercise device is provided. The method may include connecting a stop washer to a pivot of the rotating mechanism and rotatably coupling a display mount of the rotating mechanism to the pivot. The stop washer may include a tab configured to engage a stop of the pivot. The tab of the stop washer may index with the display mount such that rotation of the display mount relative to the pivot rotates the stop washer.

Additional features are set forth in part in the description that follows and will become apparent to those skilled in the art upon examination of the specification and drawings or may be learned by the practice of the disclosed subject matter. A further understanding of the nature and advantages of the present disclosure may be realized by reference to the remaining portions of the specification and the drawings, which forms a part of this disclosure.

One of skill in the art will understand that each of the various aspects and features of the disclosure may advantageously be used separately in some instances, or in combination with other aspects and features of the disclosure in other instances. Accordingly, individual aspects can be claimed separately or in combination with other aspects and features. Thus, the present disclosure is merely exemplary in nature and is in no way intended to limit the claimed invention or its applications or uses. It is to be understood that structural and/or logical changes may be made without departing from the spirit and scope of the present disclosure.

The present disclosure is set forth in various levels of detail and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. The claimed subject matter is not necessarily limited to the arrangements illustrated herein, with the scope of the present disclosure is defined only by the appended claims.

BRIEF DESCRIPTION OF THE DRAWINGS

The description will be more fully understood with reference to the following figures in which components may not be drawn to scale, which are presented as various embodiments of the rotating display mechanism for an exercise device described herein and should not be construed as a complete depiction of the scope of the oral cleansing device.

FIG. 7 illustrates a diagram of the rotating mechanism oriented in a second position relative to the handlebar to aid a user in performing one or more floor exercises next to the exercise device in accordance with an embodiment of the disclosure.

Embodiments of the disclosure and their advantages are best understood by referring to the detailed description that follows. It should be appreciated that like reference numerals may be used to identify like elements illustrated in one or more of the figures.

DETAILED DESCRIPTION

According to the present disclosure, a rotating display mechanism of an exercise device is provided. The exercise device may include a handlebar and a rotating mechanism rotatable relative to the handlebar. The rotating mechanism may include a pivot including a stop, a display mount rotatably connected to the pivot, and a tab associated with the display mount and configured to engage the stop of the pivot with rotation of the display mount relative to the pivot to define at least one stop position of the rotating mechanism. The tab may be defined on a stop washer positioned between the pivot and the display mount. The rotating mechanism may be connected to a support arm extending from the handlebar. A display may be connected to the rotating mechanism, such that rotation of the rotating mechanism positions the display in one of a plurality of positions relative to the handlebar.

Figure 1:
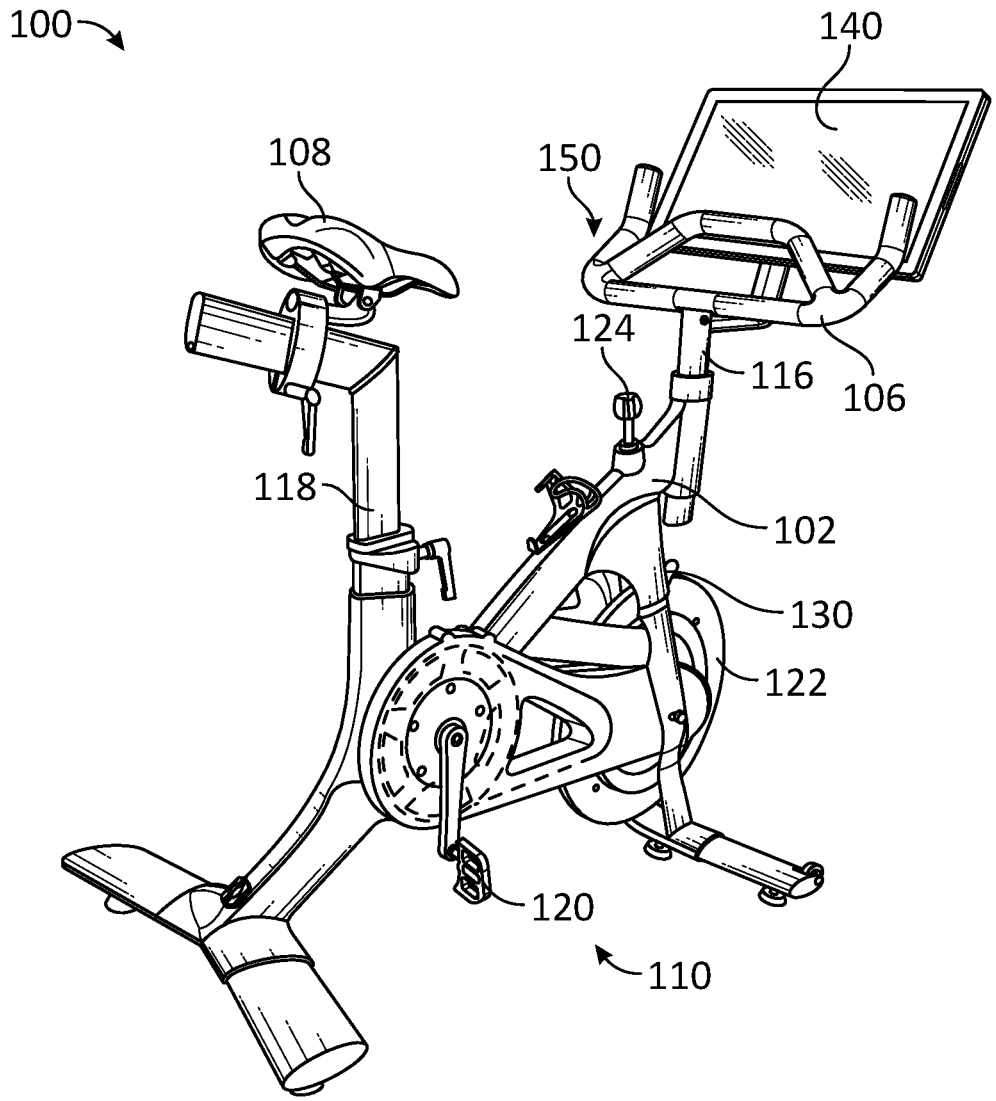
FIG. 1 illustrates a rear perspective view of an exercise device in accordance with an embodiment of the disclosure.
Figure 2:
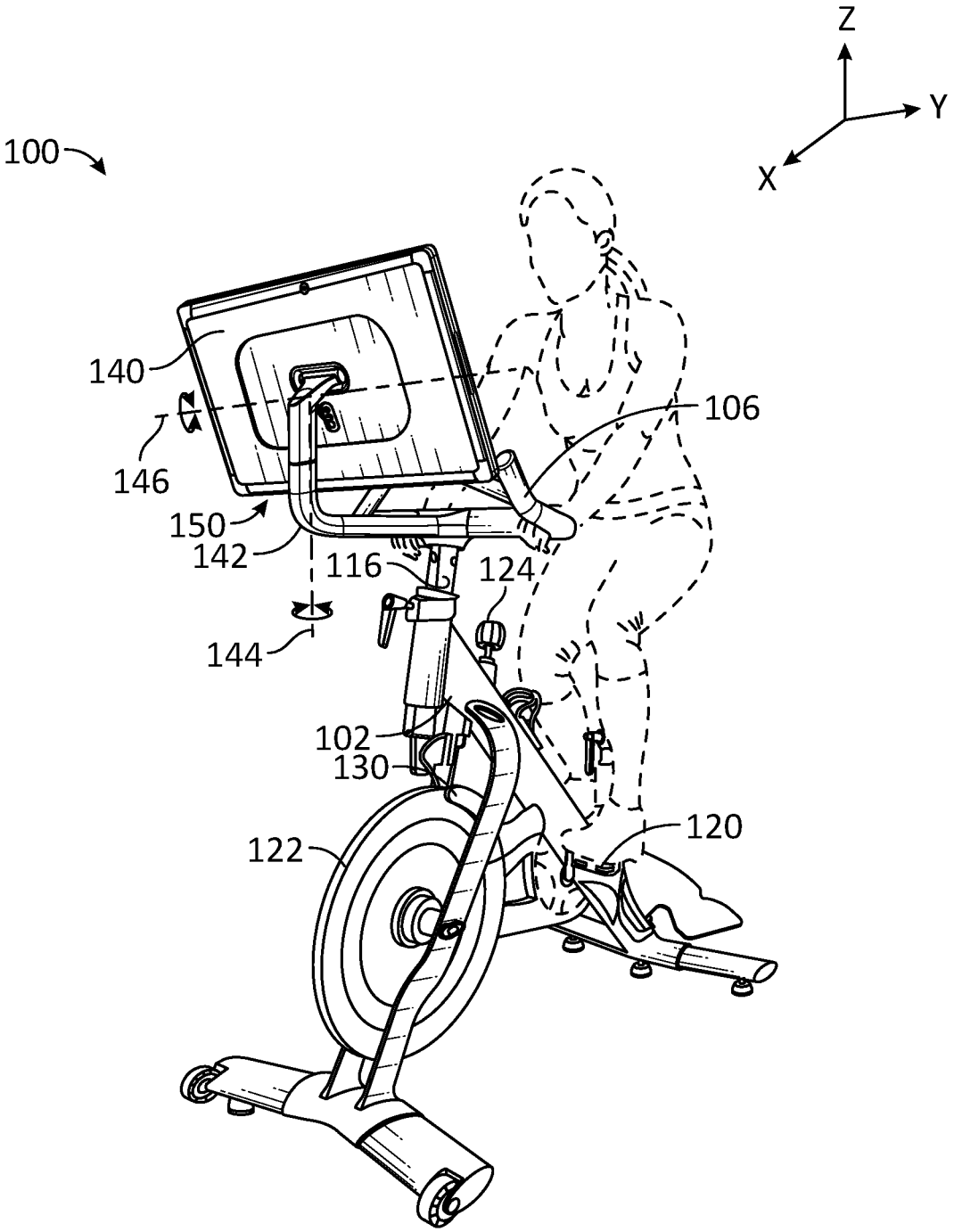
FIG. 2 illustrates a front perspective view of the exercise device of FIG. 1 in accordance with an embodiment of the disclosure.

FIG. 1 illustrates a rear perspective view of an exercise device 100 in accordance with an embodiment of the disclosure. FIG. 2 illustrates a front perspective view of the exercise device 100 in accordance with an embodiment of the disclosure. The exercise device 100 may be any type of exercise apparatus designed for cardiovascular and/or strength training of a user, such as an exercise bike, treadmill, elliptical machine, or rowing machine, among others. Referring to FIGS. 1 and 2, the exercise device 100 is embodied as an exercise bike for illustration only. However, it is contemplated that the concepts described below may be applied to other exercise apparatuses, where suitable. For example, the concepts described herein may be applied to any device where a user views a display while exercising, as described below.

As shown, the exercise device 100 may include a frame 102 and one or more components connected to the frame 102. For example, the exercise device 100 may include a handlebar 106, a seat 108, and a drive mechanism 110 for operating against a resistance structure, or any combination thereof. The handlebar 106 may be supported by a handlebar post 116, and the seat 108 may be supported by a seat post 118. In some embodiments, the exercise device 100 may include various features that allow adjustment of the position of the seat 108, the position of the handlebar 106, etc. For instance, the height of the handlebar 106 may be adjusted to fit the exercise bike to a user, such as by sliding the handlebar post 116 within the frame 102 towards or away from the frame 102. In like manner, the height of the seat 108 may be adjusted to fit the exercise bike to the user, such as by sliding the seat post 118 within the frame 102 towards and away from the frame 102. In some embodiments, the seat 108 may be adjusted towards or away from the handlebar 106 to further fit the exercise bike to the user.

The drive mechanism 110 may include many configurations. For example, the drive mechanism 110 may include a pair of pedals 120 connected to a crank configured to drive a flywheel 122 through a belt, chain, gearing, or other mechanism. Depending on the application, the flywheel 122 may be a heavy metal disc, an air resistance mechanism, or other suitable device designed for cardiovascular and/or strength training of a user. In some embodiments, the force required to spin the flywheel 122 may be adjusted, such as via a resistance adjustment knob 124 that directly or indirectly increases or decreases a resistance of the flywheel 122 to rotation. For instance, rotation of the resistance adjustment knob 124 in a first direction may cause a resistance structure 130 (e.g., magnets, friction pad, etc.) to move relative to the flywheel 122 in a first manner, increasing the resistance of the flywheel 122 to rotation and increasing the force that the user must apply to the pedals 120 to rotate the flywheel 122. Similarly, rotation of the resistance adjustment knob 124 in a second direction may cause the resistance structure 130 to move relative to the flywheel 122 in a second manner, decreasing the resistance of the flywheel 122 to rotation and decreasing the force that the user must apply to the pedals 120 to rotate the flywheel 122.

In some embodiments, the exercise device 100 may include a display 140 configured to render information (e.g., commands, workout progress, entertainment, etc.) to the user. For example, the display 140 may render one or more video streams, a range of performance metrics, and a range of controls. In some embodiments, the display 140 may be used to access membership information, login or logout of an exercise management system, present live and/or archived exercise classes, and other content. In some embodiments, the display 140, or at least the information rendered on the display, may be similar to the display or method disclosed in U.S. Patent Application Publication No. 2019/0262665 A1 entitled "EXERCISE SYSTEM AND METHOD," the disclosure of which is hereby incorporated herein by reference in its entirety.

To allow viewing of the display 140 by the user, the display 140 may be mounted in front of the user forward of the handlebar 106 (i.e., such that the handlebar 106 is positioned between the display 140 and the seat 108). The display 140 may be mounted to the exercise device 100 in many configurations. For instance, the exercise device 100 may include a support arm 142 extending from the handlebar 106. Depending on the application, the support arm 142 may be cantilevered from the handlebar 106, attached to the handlebar 106, or the like. The display 140 may be connected to the support arm 142 to place the display 140 within a viewing area of the user during exercise. The display 140 may be mounted to the support arm 142 via one or more devices or mechanisms configured to adjust the position or orientation of the display 140, as detailed more fully below. For example, the display 140 may be mounted to the support arm 142 in a manner allowing the display 140 to rotate relative to the handlebar 106 or the support arm 142, such as to orient the display 140 towards the user during exercise.

Referring to FIG. 2, an XYZ coordinate system may define relative orientations or directions between one or more components of the exercise device 100. For example, the XYZ coordinate system may include an X-axis, a Y-axis, and a Z-axis. The X-axis may run generally along the length of the exercise device 100, such as between the front and rear of the exercise device 100. For example, the X-axis may run along a direction substantially parallel to and/or aligned with a longitudinal axis of the exercise device 100. The Y-axis may be perpendicular to the X-axis and run generally along the width of the exercise device 100, such as between the left and right sides of the exercise device 100. For example, the Y-axis may run along a direction substantially parallel to and/or aligned with a lateral axis of the exercise device 100. The Z-axis may be perpendicular to both the X-axis and the Y-axis and run generally along the height of the exercise device 100, such as between the top and bottom of the exercise device 100. For example, the Z-axis may run along a direction substantially parallel to and/or aligned with a vertical axis of the exercise device 100.

In such embodiments, the display 140 may rotate about one or more axes. For example, the display 140 may rotate about a first axis 144 to pan the display 140 left and right relative to the handlebar 106. In some embodiments, the display 140 may rotate about a second axis 146 to tilt the display 140 up and down relative to the handlebar 106. The first axis 144 may be parallel to the Z-axis, perpendicular to the Y-axis, lie within the XZ plane formed by the X-axis and the Z-axis, or be parallel to the XZ plane, among others. In some embodiments, at least a portion of the support arm 142 may define a vertical plane, with the first axis 144 extending within the vertical plane defined by the support arm 142. The second axis 146 may be parallel to the Y-axis, perpendicular to the Z-axis, lie within the YZ plane formed by the Y-axis and the Z-axis, or be parallel to the YZ plane, among others. In some embodiments, the first axis 144 may be a vertical axis or a generally vertical axis, and the second axis 146 may be a horizontal axis or a generally horizontal axis.

Figure 3:
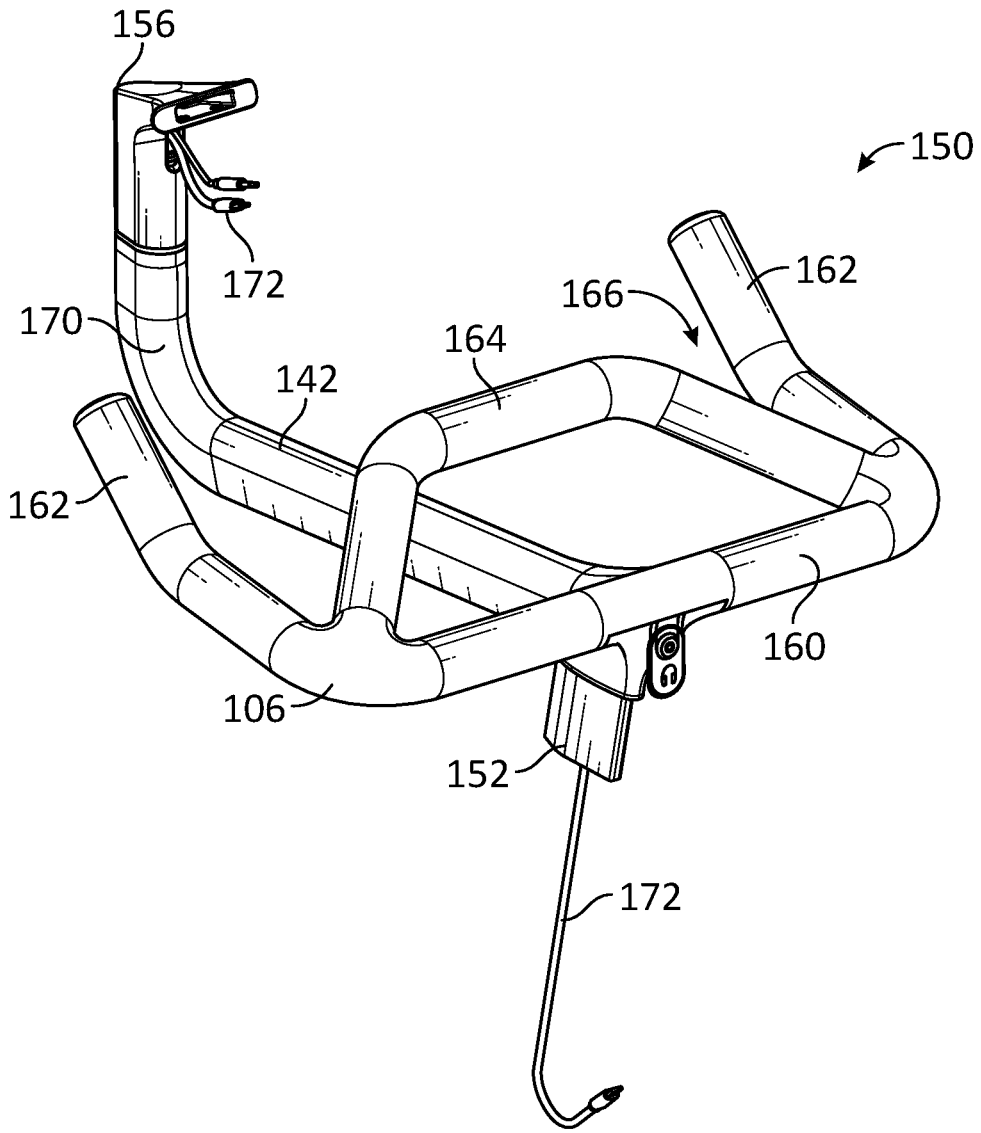
FIG. 3 illustrates a perspective view of a handlebar assembly in accordance with an embodiment of the disclosure.

FIG. 3 illustrates a perspective view of a handlebar assembly in accordance with an embodiment of the disclosure. Referring to FIG. 3, the display 140 may be mounted to the exercise device 100 via a handlebar assembly 150. The handlebar assembly 150 may be configured as a single unit for attachment to the exercise device 100. For example, the handlebar assembly 150 may include a boss 152 configured for attachment to the handlebar post 116. In this manner, the handlebar assembly 150 may be attached to the exercise device 100 during original assembly of the exercise device 100, or the handlebar assembly 150 may be provided as a replacement part. In some embodiments, legacy exercise devices may be retrofitted with the handlebar assembly 150 to take advantage of one or more upgraded features of the handlebar assembly 150 compared to existing units.

As shown, the handlebar assembly 150 may include the handlebar 106, the support arm 142 extending from the handlebar 106, and a rotating mechanism 156 connected to the support arm 142. As shown, the handlebar 106 may include a main bar 160, a pair of bar ends 162 extending from the main bar 160, and a secondary bar 164 extending from the main bar 160 between the pair of bar ends 162. The various bars of the handlebar 106 may provide a plurality of handholds for the user during exercise. For example, the main bar 160 may provide a straight bar section between the pair of bar ends 162. The pair of bar ends 162 may extend forwardly from the ends of the main bar 160 towards the rotating mechanism 156. The bar ends 162 may extend upwardly away from the support arm 142, such as gradually or in a stepped linear fashion. Depending on the application, the bar ends 162 may extend parallel or generally parallel to each other. In some embodiments, the pair of bar ends 162 may define a space 166 bounded by the bar ends 162. The secondary bar 164 may form a loop with the main bar 160 and extend upwardly away from the support arm 142, similar to the pair of bar ends 162.

The user may grasp the handlebar 106 at the various bars as desired for comfort and convenience. For instance, the user may grasp the main bar 160 to position the user in an upright seated position. The user may grasp the bar ends 162 to position the user in a more forward, bent-over position. Grasping the second bar may position the user somewhere between the upright seated position and the forward, bent-over position. Moving from the main bar 160 to the secondary bar 164 may supinate the user's forearm, such as from a full pronation of the forearm when grasping the main bar 160 to a position between full pronation and a natural position of the forearm when grasping the secondary bar 164. Moving from the secondary bar 164 to the bar ends 162 may further supinate the user's forearm, such as to a natural position of the forearm when grasping the bar ends 162. Moving from the main bar 160 to the secondary bar 164, and from the secondary bar 164 to the bar ends 162, may widen the user's hold on the handlebar 106. In like manner, moving from the bar ends 162 to the secondary bar 164, and from the secondary bar 164 to the main bar 160, may narrow the user's hold on the handlebar 106. In this manner, the user may vary a hold width, forearm position, and posture as desired based on the grasping position with the handlebar 106.

The support arm 142 may extend from the main bar 160 of the handlebar 106. In some embodiments, the support arm 142 may extend generally orthogonal from the main bar 160 and from the centerline of the main bar 160. As shown, the handlebar 106 is mirrored across the support arm 142, although other configurations are contemplated. The support arm 142 may have a length extending between the handlebar 106 and a terminal end 170. The terminal end 170 may be curved, such as upwardly towards vertical. In some embodiments, the support arm 142 is hollow to allow one or more cables 172 (e.g., a data cable, a voice cable, etc.) to extend through the support arm 142, as explained below.

The rotating mechanism 156 may rotatably connect the display 140 to the handlebar 106. For instance, the rotating mechanism 156 may be connected to the terminal end 170 of the support arm 142. As described herein, the rotating mechanism 156 may be rotatably coupled to the support arm 142 such that at least a portion of the rotating mechanism 156 is rotatable relative to the handlebar 106. As shown in FIG. 2, the display 140 may be connected to the rotating mechanism 156. In such embodiments, rotation of the rotating mechanism 156 may rotate the display 140 to position the display 140 in one of a plurality of positions relative to the handlebar 106, as detailed below. For instance, rotation of the rotating mechanism 156 may rotate the display 140 to position the display 140 as desired by the user, such as towards the seat 108, away from the seat 108, or the like. In this manner, the user may position the display 140 towards the seat 108 to perform one or more exercises using the exercise device 100. When one or more floor exercises are desired to be performed by the user, the display 140 may be rotated away from the seat 108 such that the user may perform the one or more floor exercises next to the exercise device 100, as described more fully below.

The display 140 may be rotated by the rotating mechanism 156 between the pair of bar ends 162, such as at least partially within the space 166 defined between the pair of bar ends 162. For example, rotation of the display 140 by the rotating mechanism 156 may position at least a portion of the display 140 within the space 166 between the bar ends 162 as the display 140 rotates or moves between positions. The display 140 may be panned about the first axis 144 left and right within the space 166 between the bar ends 162. In some embodiments, the display 140 may be tilted about the second axis 146 up and down within the space 166 between the bar ends 162. The bar ends 162 may be spaced wide enough to accommodate panning of the display 140 (e.g., to accommodate the size of the display 140). For instance, a larger display may necessitate the bar ends 162 being positioned further apart, with smaller displays allowing the bar ends 162 to be positioned closer together.

Figure 4:
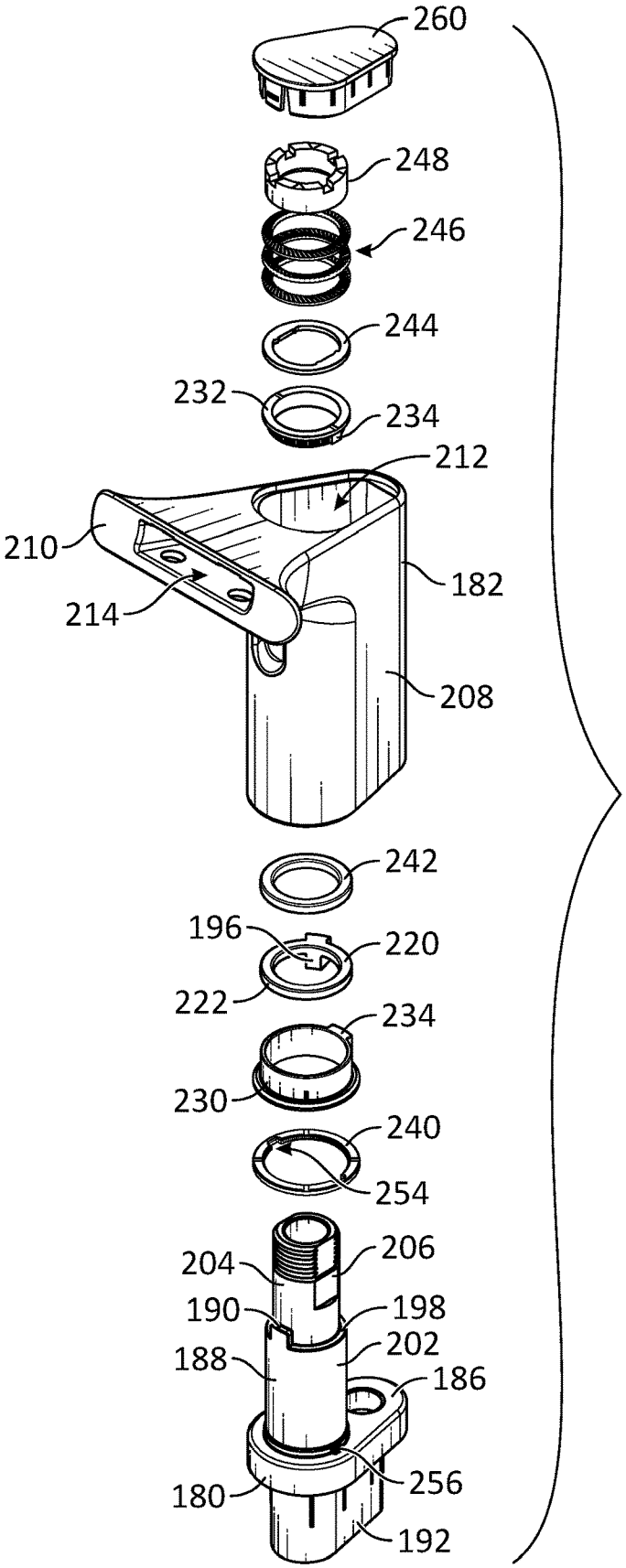
FIG. 4 illustrates an exploded view of a rotating mechanism in accordance with an embodiment of the disclosure.
Figure 5:
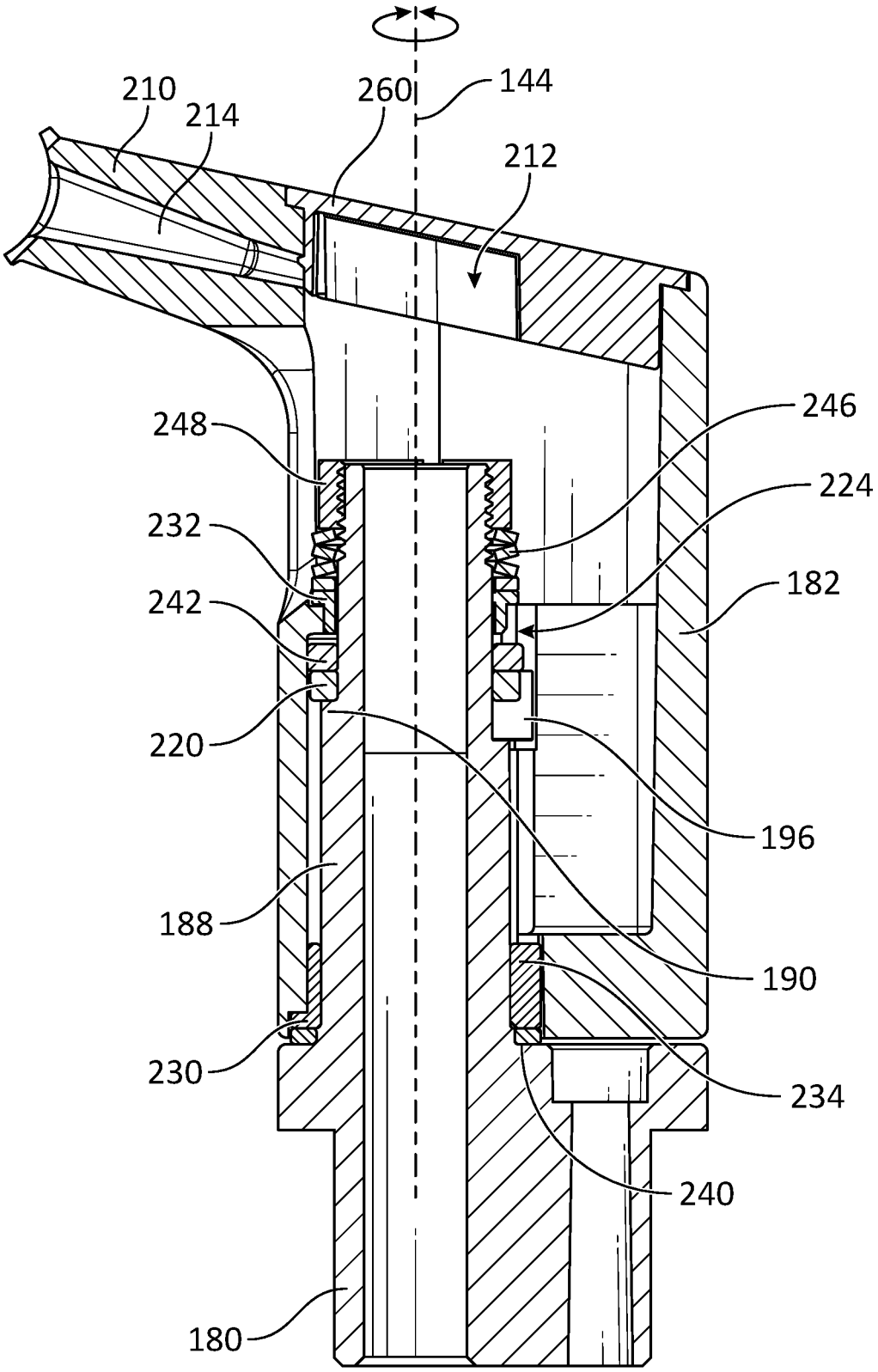
FIG. 5 illustrates a cross-sectional view of the rotating mechanism in accordance with an embodiment of the disclosure.

FIG. 4 illustrates an exploded view of the rotating mechanism 156 in accordance with an embodiment of the disclosure. FIG. 5 illustrates a cross-sectional view of the rotating mechanism 156 in accordance with an embodiment of the disclosure. Referring to FIGS. 4 and 5, the rotating mechanism 156 includes a pivot 180 and a display mount 182 connected to the pivot 180. The pivot 180 may include a base 186, a shaft 188 extending from the base 186, and a stop 190. In such embodiments, the base 186 may be connected to the terminal end 170 of the support arm 142, such as via one or more mechanical fasteners. In some embodiments, the base 186 may include one or more anti-rotation features to limit movement of the base 186 relative to the support arm 142. For example, the support arm 142 may include a non-circular shape. The base 186 may include an attachment structure 192 positionable within the support arm 142 and having a shape complementary to the non-circular shape of the support arm 142 to limit rotation of the base 186 relative to the support arm 142.

The pivot 180 may include various features defining rotation of the display mount 182. For example, the pivot 180 may include the stop 190, such as defined on the shaft 188. As described below, rotation of the display mount 182 relative to the pivot 180 may engage the stop 190 to limit further rotation. For example, the rotating mechanism 156 may include a tab 196 indexed or otherwise associated with the display mount 182, the tab 196 configured to engage the stop 190 of the pivot 180 with rotation of the display mount 182 about the shaft 188 to define at least one stop position of the rotating mechanism 156. For example, engagement of the tab 196 with the stop 190 may define a stop position of the rotating mechanism 156 orienting the display 140 away from the seat 108 allowing the user to perform one or more floor exercises next to the exercise device 100.

Referring to FIG. 4, the shaft 188 may include a shelf 198. For example, the shaft 188 may include a first shaft portion 202 extending from the base 186 and a second shaft portion 204 extending from the first shaft portion 202. The first shaft portion 202 may have a first diameter and the second shaft portion 204 may have a second diameter different than the first diameter. The shaft 188 may be stepped between the first shaft portion 202 and the second shaft portion 204 to define the shelf 198. In such embodiments, the stop 190 may be defined on the shelf 198 of the shaft 188. As a result, the tab 196 may ride on the shelf 198 with rotation of the display mount 182 about the shaft 188 to engage the stop 190. For example, rotation of the display mount 182 about the shaft 188 may cause the tab 196 to slide along or otherwise ride on the shelf 198 until the tab 196 engages the stop 190, limiting further rotation of the display mount 182 about the shaft 188. Although the tab 196 is described as riding on the shelf 198 during rotation of the display mount 182 about the shaft 188, it is contemplated that a gap may exist between the tab 196 and the shelf 198. The second shaft portion 204 may be threaded and may include one or more flats 206 machined or otherwise defined on the shaft 188.

As shown in FIG. 5, the shaft 188 may be hollow, and the display mount 182 may rotate about the shaft 188. In such embodiments, the one or more cables 172 may run through the support arm 142 and the shaft 188 for connection with the display mount 182. As a result, the display mount 182 may rotate about the shaft 188 without interference from the one or more cables 172, and without damaging the cables 172 themselves. In addition, running the one or more cables 172 through the support arm 142 and the shaft 188 may conceal and protect the cables 172 from damage and provide a clean appearance for the exercise device 100. As shown, the shaft 188 may define the first axis 144, with the display mount rotatable about the first axis 144 to reposition the display 140.

Referring to FIG. 4, the display mount 182 may include various features allowing the display mount 182 to be connected to the pivot 180 to rotate about the shaft 188 to reposition the display 140. For example, the display mount 182 may include a main body 208 and a mounting flange 210 extending from the main body 208. The main body 208 may be connected to the shaft 188 of the pivot 180, and the display 140 may be connected to the mounting flange 210 to connect the display 140 to the rotating mechanism 156. For instance, the mounting flange 210 may be shaped to mount to a rear portion of the display 140.

Each of the main body 208 and the mounting flange 210 may be hollow to connect the display mount 182 to the pivot 180 and/or to run the cables 172 through the display mount 182. For example, the main body 208 may include a first cavity 212 and the mounting flange 210 may include a second cavity 214. In such embodiments, the shaft 188 may be received within the first cavity 212 of the main body 208 to connect the display mount 182 to the pivot 180. The cables 172 may also run through the first cavity 212 and the second cavity 214 for connection with the display 140.

With continued reference to FIG. 4, the rotating mechanism 156 may include various features interfacing the display mount 182 with the pivot 180. For example, the rotating mechanism 156 may include a stop washer 220 positioned around the shaft 188 between the shaft 188 and the display mount 182. The stop washer 220 may include a ring body 222 and the tab 196 extending from the ring body 222. In such embodiments, the ring body 222 may ride on the stop 190 and the tab 196 may ride on the shelf 198 of the shaft 188 as the stop washer 220 rotates about the shaft 188, such as with rotation of the display mount 182 about the shaft 188. For example, as shown in FIG. 5, the display mount 182 may include a recess 224 defined within the first cavity 212 of the main body 208. The tab 196 may be received at least partially within the recess 224 of the display mount 182 to index the tab 196 with the display mount 182 and tie movement of the tab 196 with rotation of the display mount 182 about the shaft 188. Depending on the application, the tab 196 may fit loosely within the recess 224 or may be connected to the display mount 182 through an interference fit. In some embodiments, the tab 196 may be formed integrally with the display mount 182, in which case the stop washer 220 may be omitted from the assembly.

As shown in FIG. 4, the display mount 182 may include a first bushing 230 and a second bushing 232. The first bushing 230 may be connected to a bottom of the display mount 182 to rotatably connect the display mount 182 to the first shaft portion 202 of the pivot 180. Similarly, the second bushing 232 may be connected to a top of the display mount 182 to rotatably connect the display mount 182 to the second shaft portion 204 of the pivot 180. For example, the first bushing 230 may be sized to rotate on the first shaft portion 202 as the display mount 182 rotates about the shaft 188, and the second bushing 232 may be sized to rotate on the second shaft portion 204 as the display mount 182 rotates about the shaft 188. In some embodiments, each of the first bushing 230 and the second bushing 232 may include a locating tab 234 for indexing the first bushing 230 and the second bushing 232 with the display mount 182. The locating tabs 234 may interface with the display mount 182 to limit movement of the bushings relative to the display mount 182. As shown, the first bushing 230 and the second bushing 232 may be flanged to seat the bushings against the display mount 182.

The rotating mechanism 156 may include other components located on the shaft 188 of the pivot 180. For instance, the rotating mechanism 156 may include a first washer 240, a sleeve 242, a second washer 244, one or more spring washers 246 (e.g., a single spring washer 246, two spring washers 246, three spring washers 246, more than three spring washers 246, etc.), and a nut 248, or any combination thereof. As shown, the first washer 240 may be positioned between the base 186 of the pivot 180 and the first bushing 230, the sleeve 242 may be positioned between the stop washer 220 and the second bushing 232, the second washer 244 may be positioned between the second bushing 232 and the spring washers 246, and the spring washers 246 may be positioned between the second washer 244 and the nut 248.

The first washer 240, sleeve 242, second washer 244, spring washers 246, and nut 248 may include many configurations. For example, each of the first washer 240 and the second washer 244 may include anti-rotation features to limit rotation of the washers relative to the shaft 188. For instance, the first washer 240 may include one or more indents 254 that interface with one or more protrusions 256 on the shaft 188. The second washer 244 may include a non-circular shape to engage or otherwise interface with the flats 206 of the shaft 188. Such configurations are exemplary only, and the first washer 240 and the second washer 244 may be indexed with the shaft 188 in other configurations. The sleeve 242 may be sized to ensure engagement of the tab 196 with the stop 190. For example, the sleeve 242 may define the position of the stop washer 220 on the shaft 188, such as limiting axial movement of the stop washer 220 along the shaft 188 away from the shelf 198 and/or stop 190.

Each spring washer 246 may have a frusto-conical shape that provides the spring washer 246 with a spring characteristic. For example, each spring washer 246 may include a conical shell that can be loaded along its axis either statically or dynamically. The spring washers 246 may be a coned disc spring, a conical spring washer, a disc spring, a Belleville spring, a Belleville washer, or a cupped spring washer. The spring washers 246 may include many profiles and configurations. For example, the spring washers 246 may be ribbed. The spring washers 246 may be stacked in many configurations to achieve a desired spring rate to provide sufficient spring pressure against the display mount 182 to reduce axial slop of the display mount 182 relative to the shaft 188 and still allow rotation of the display mount 182 about the shaft 188. For example, the spring washers 246 may be stacked in alternate or alternating orientations. The nut 248 may be threaded to the threaded portion of the shaft 188 and against the spring washers 246 to secure the display mount 182 to the pivot 180. As shown, the nut 248 may be a castle nut, although other configurations are contemplated. To conceal the attachment of the display mount 182 to the shaft 188, the rotating mechanism 156 may include a cap 260 snap-fitted to the main body 208 of the display mount 182.

Referring to FIGS. 4 and 5, assembly of the rotating mechanism 156 will now be discussed in detail. Each of the first bushing 230 and the second bushing 232 may be press fit to the display mount 182, such as the first bushing 230 press fit to the bottom of the display mount 182 and the second bushing 232 press fit to the top of the display mount 182. The first washer 240 may be press fit to the shaft 188, such as against the base 186 of the pivot 180, with the one or more protrusions 256 of the shaft 188 received within the one or more indents 254 of the first washer 240. The stop washer 220 may then be slid or dropped onto the shaft 188 (e.g., onto the second shaft portion 204), with the ring body 222 engaging the top of the stop 190 and the tab 196 engaging the shelf 198. The sleeve 242 may then be slid or dropped onto the shaft 188 and against the stop washer 220.

The display mount 182 with the first bushing 230 and the second bushing 232 attached may then be slid or dropped onto the shaft 188, such as until the first bushing 230 engages the first washer 240 and/or the second bushing 232 engages the sleeve 242. The second washer 244 may then be slid or dropped onto the shaft 188 and against the second bushing 232, with the second washer 244 oriented to interface with the flats 206 of the shaft 188. The spring washers 246 may then be slid or dropped onto the shaft 188 and against the second washer 244, such as in an alternate orientation as described above. The nut 248 may then be threaded to the shaft 188 and torqued to specification, such as between 5 N-m and 10 N-m. The cap 260 may then be attached to the display mount 182 to conceal the attachment of the display mount 182 to the pivot 180.

Once the rotating mechanism 156 is assembled, the display mount 182 may rotate about the shaft 188 until the tab 196 engages the stop 190. For example, the display mount 182 may rotate about the shaft 188 in a first direction until the tab 196 engages a first side of the stop 190. Similarly, the display mount 182 may rotate about the shaft 188 in a second direction until the tab 196 engages a second side of the stop 190. As a result, engagement of the tab 196 with the first side of the stop 190 may define a first stop position of the rotating mechanism 156, and engagement of the tab 196 with the second side of the stop 190 may define a second stop position of the rotating mechanism 156. In this manner, the display mount 182 may rotate freely about the shaft 188 between the first stop position and the second stop position.

Figure 6:
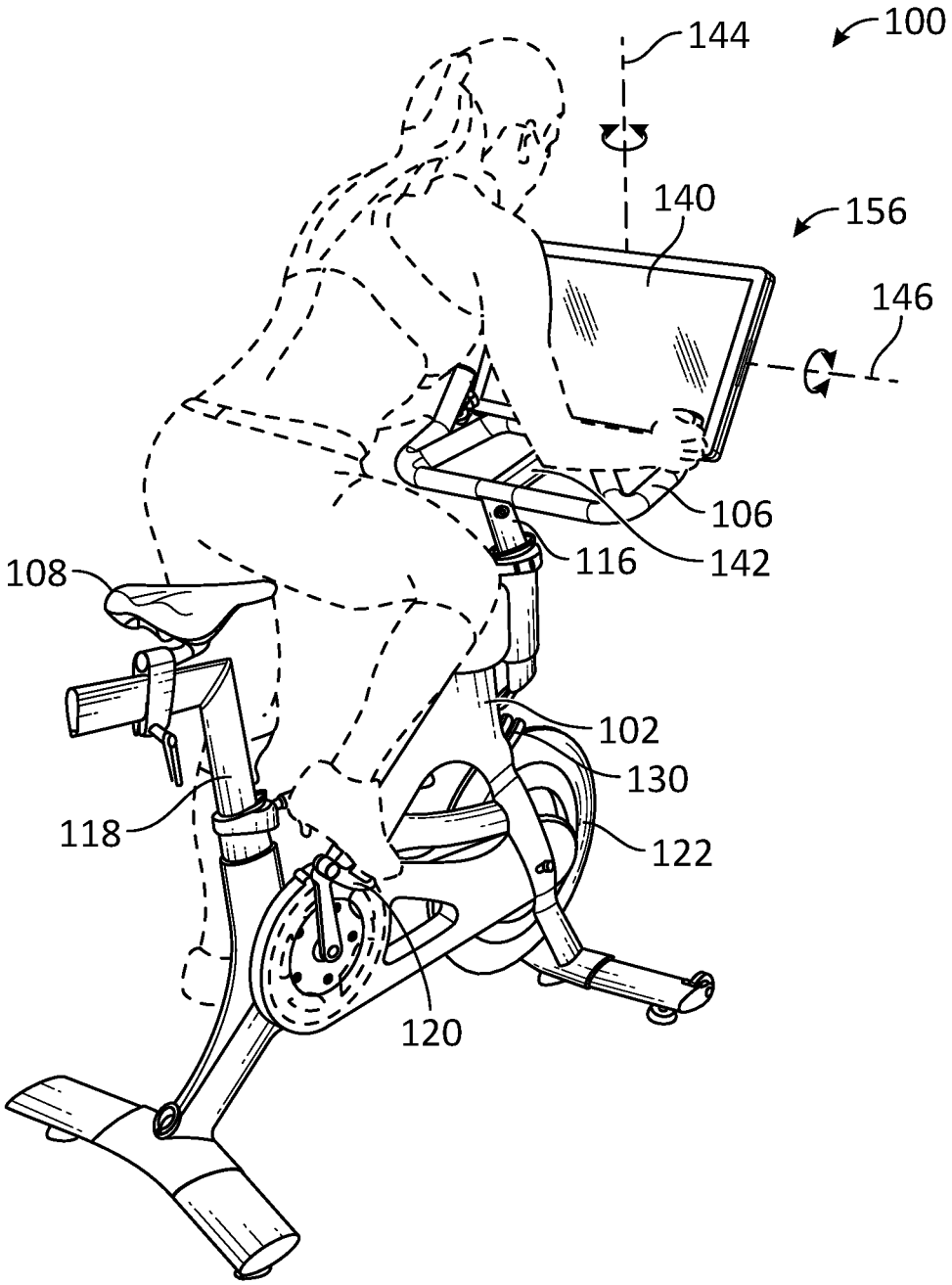
FIG. 6 illustrates a diagram of the rotating mechanism oriented in a first position relative to the handlebar to aid a user in performing one or more exercises using the exercise device in accordance with an embodiment of the disclosure.
Figure 8:
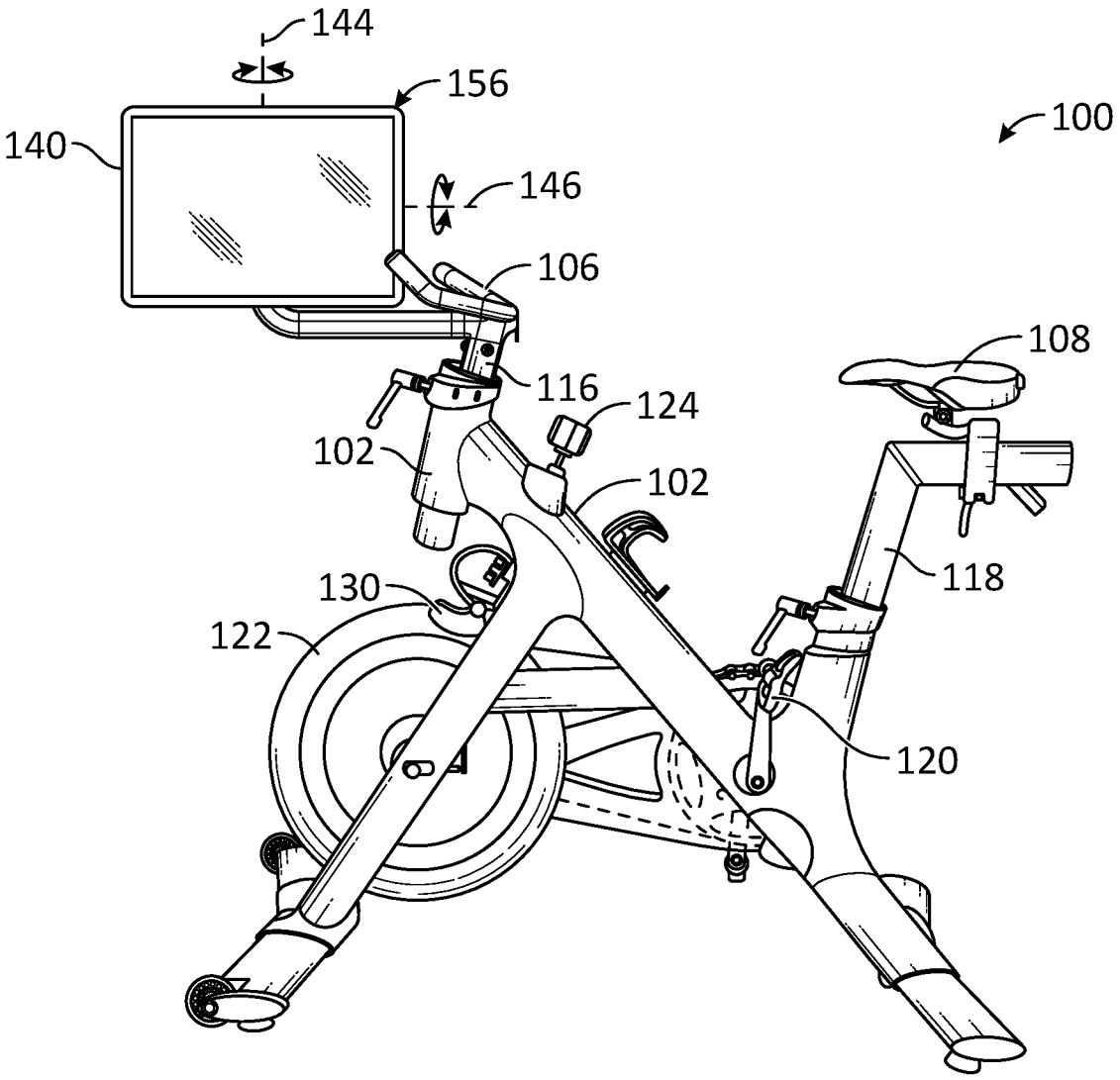
FIG. 8 illustrates a diagram of the rotating mechanism oriented in a third position relative to the handlebar in accordance with an embodiment of the disclosure.

FIG. 6 illustrates a diagram of the rotating mechanism 156 oriented in a first position relative to the handlebar 106 to aid a user in performing one or more exercises using the exercise device 100 in accordance with an embodiment of the disclosure. FIG. 7 illustrates a diagram of the rotating mechanism 156 oriented in a second position relative to the handlebar 106 to aid a user in performing one or more floor exercises next to the exercise device 100 in accordance with an embodiment of the disclosure. FIG. 8 illustrates a diagram of the rotating mechanism 156 oriented in a third position relative to the handlebar 106 in accordance with an embodiment of the disclosure. Referring to FIGS. 6-8, rotation of the display mount 182 about the first axis 144 may rotate the display 140 about the pivot 180 to position the display 140 in one of a plurality of positions. For example, referring to FIG. 6, the display mount 182 may be rotated about the pivot 180 (e.g., panned about the first axis 144) to orient the display 140 towards the handlebar 106 and/or seat 108 to place the display 140 within a viewing area of the user while the user is using the exercise device 100 (e.g., seated on the seat 108, standing on the pedals 120, etc.). The display 140 may also be tilted about the second axis 146 to further orient the display 140 towards the user. For example, the display 140 may be tilted up about the second axis 146 to orient the display 140 within the field of view of a taller user. In like manner, the display 140 may be tilted down about the second axis 146 to orient the display 140 within the field of view of a shorter user.

Referring to FIG. 7, the display mount 182 may be panned about the first axis 144 to rotate the display 140 about the pivot 180 to orient the display 140 away from the handlebar 106 and/or seat 108 to place the display 140 within a viewing area of the user while the user is performing one or more exercises next to the exercise device 100 (e.g., strength training, yoga, or another floor exercise). The display 140 may also be tilted about the second axis 146 to further orient the display 140 towards the user. For example, the display 140 may be tilted up about the second axis 146 to orient the display 140 within the field of view of a taller user. In like manner, the display 140 may be tilted down about the second axis 146 to orient the display 140 within the field of view of a shorter user. As shown in FIG. 7, the display mount 182 may be panned about the first axis 144 until the display 140 is oriented directly away from the handlebar 106 and/or seat 108. Referring to FIG. 8, the display mount 182 may be rotated about the first axis 144 (i.e., panned) to position the display 140 in other orientations/positions. For example, the display mount 182 may be panned to orient the display 140 to the side of the exercise device 100, to a diagonal or oblique position of the exercise device 100, or to any other position of the exercise device 100.

In some embodiments, the first stop position may orient the rotating mechanism 156 away from the handlebar 106 and/or seat 108. For example, the rotating mechanism 156 may be rotated away from the handlebar 106 and/or seat 108 until the tab 196 engages the stop 190 at the first stop position, which may orient the display 140 away from the handlebar 106 and/or seat 108, such as shown in FIG. 7. The second stop position may also orient the rotating mechanism 156 away from the handlebar 106 and/or seat 108. For instance, the rotating mechanism 156 may be rotated away from the handlebar 106 and/or seat 108 until the tab 196 engages the stop 190 at the second stop position, which may orient the display 140 away from the handlebar 106 and/or seat 108, such as shown in FIG. 7. In this manner, both the first stop position and the second stop position may orient the rotating mechanism 156 away from the handlebar 106 and/or seat 108, with engagement of the tab 196 with the stop 190 at the first stop position or the second stop position dependent upon the rotation direction of the display mount 182 about the shaft 188 (e.g., clockwise to the first stop position, counterclockwise to the second stop position, or similar).

In some embodiments, the first stop position may define an extent of rotation of the rotating mechanism 156 away from the handlebar 106 and/or seat 108, and the second stop position may define an extent of rotation of the rotating mechanism 156 towards the handlebar 106 and/or seat 108. For instance, the display mount 182 may be rotated to the first stop position to place the display 140 within a viewing area of the user while the user is performing one or more exercises next to the exercise device 100. The display mount 182 may be rotated to the second stop position to place the display 140 within a viewing area of the user while the user is using the exercise device 100.

Figure 9:
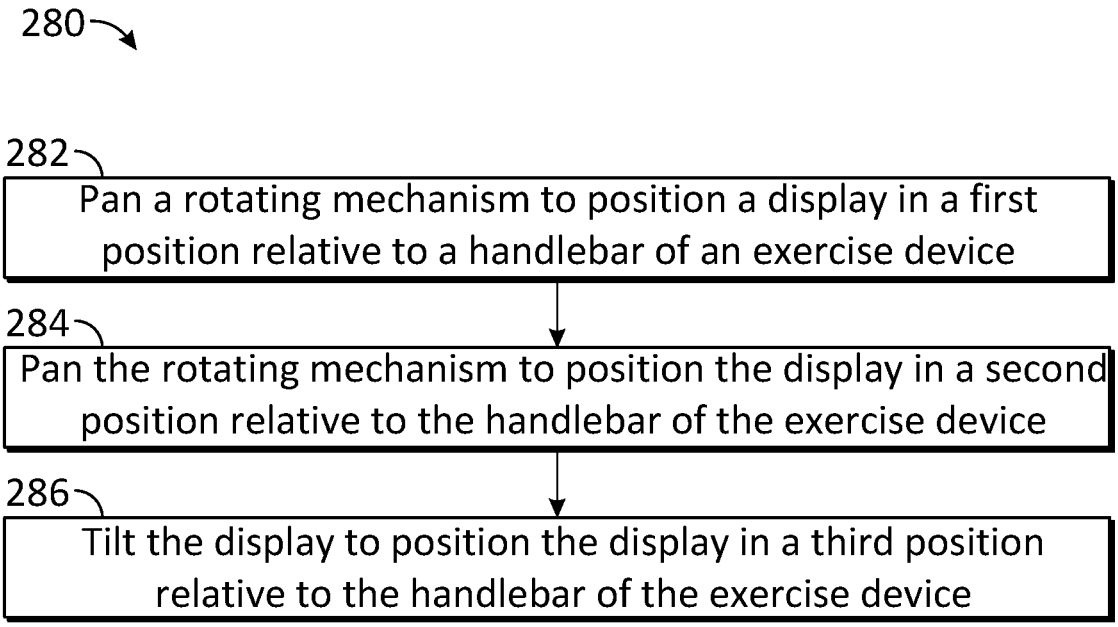
FIG. 9 illustrates a flow diagram of a process of operating a rotating mechanism in accordance with an embodiment of the disclosure.

FIG. 9 illustrates a flow diagram of a process 280 of operating a rotating mechanism configured to reposition a display or other device of an exercise device in a plurality of positions in accordance with an embodiment of the disclosure. Any step, sub-step, sub-process, or block of process 280 may be performed in an order or arrangement different from the embodiments illustrated in FIG. 9. For example, one or more blocks may be omitted from or added to the process 280. Although process 280 is described with reference to the embodiments of FIGS. 1-8, process 280 may be applied to other embodiments.

In Block 282, process 280 may include panning the rotating mechanism to position a display in a first position relative to a handlebar of an exercise device. For instance, the rotating mechanism may be panned to the left or to the right to position the display in the first position. In some embodiments, the first position may be a stop position of the rotating mechanism. For example, the rotating mechanism may be panned in a first direction (e.g., clockwise rotating) until the rotating mechanism engages a stop limiting further movement of the rotating mechanism in the first direction. As described above, the first position may orient the display relative to the handlebar to aid a user in performing one or more exercises using the exercise device, such as orienting the display towards a seat of the exercise device.

In Block 284, process 280 may include panning the rotating mechanism to position the display in a second position relative to the handlebar of the exercise device. For example, the rotating mechanism may be panned to the left or to the right of the first position to position the display in the second position. In some embodiments, the second position may be a stop position of the rotating mechanism. For instance, the rotating mechanism may be panned in a second direction (e.g., counterclockwise rotating) until the rotating mechanism engages a stop limiting further movement of the rotating mechanism in the second direction. As described above, the second position may orient the display relative to the handlebar to aid a user in performing one or more floor exercises next to the exercise device, such as orienting the display away from the seat of the exercise device.

In Block 286, process 280 may include tilting the display to position the display in a third position relative to the handlebar of the exercise device. For instance, the display may be tilted up or down relative to the handlebar to further orient the display towards the user, such as tilting the display to better orient the display within the field of view of the user. For example, a taller user may require the display to be tilted upwardly away from the handlebar, whereas a shorter user may require the display to be tilted downwardly towards the handlebar.

Figure 10:
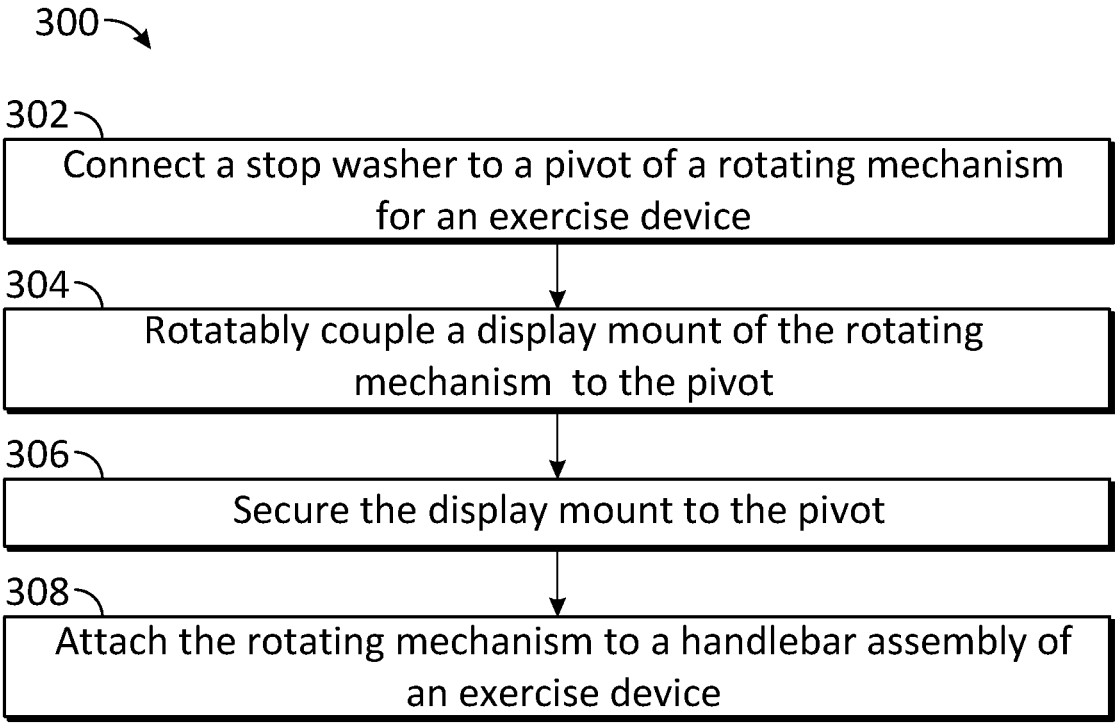
FIG. 10 illustrates a flow diagram of a process of assembling a rotating mechanism in accordance with an embodiment of the disclosure.
Figure 11:
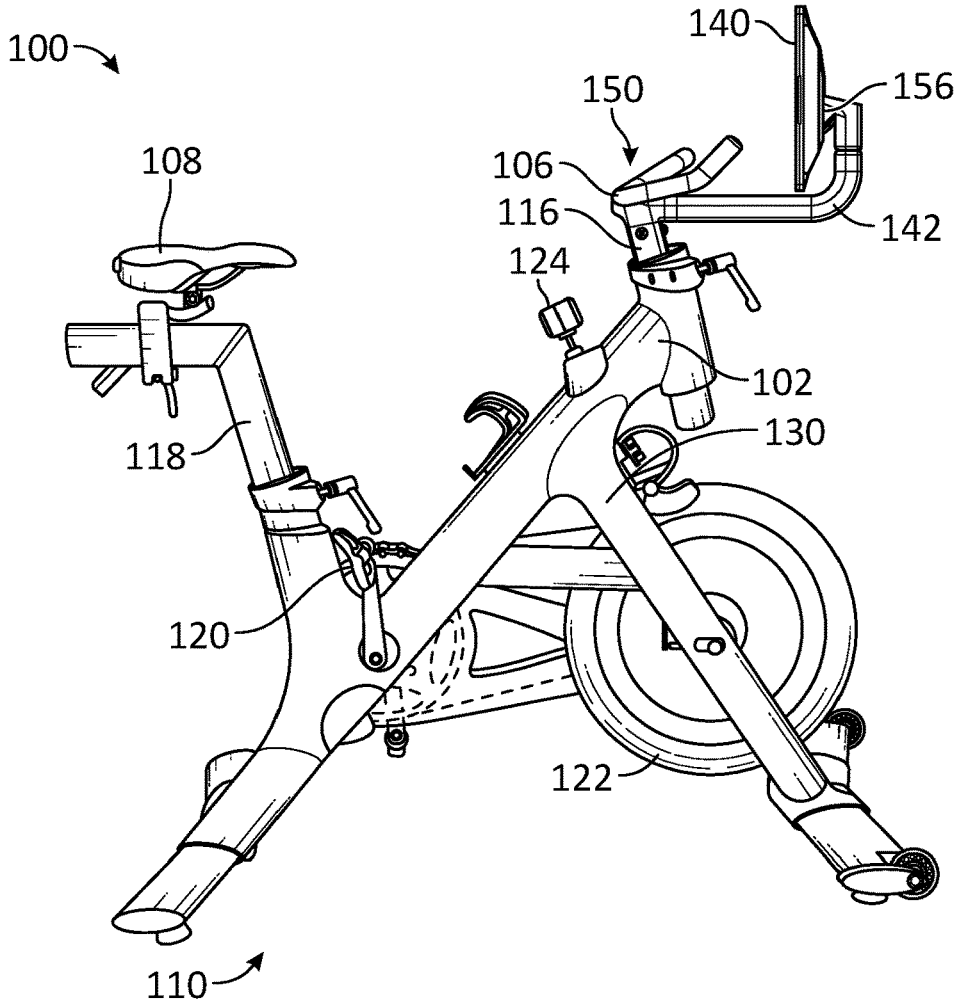
FIG. 11 illustrates a diagram of an exercise device in accordance with an embodiment of the disclosure.
Figure 12:
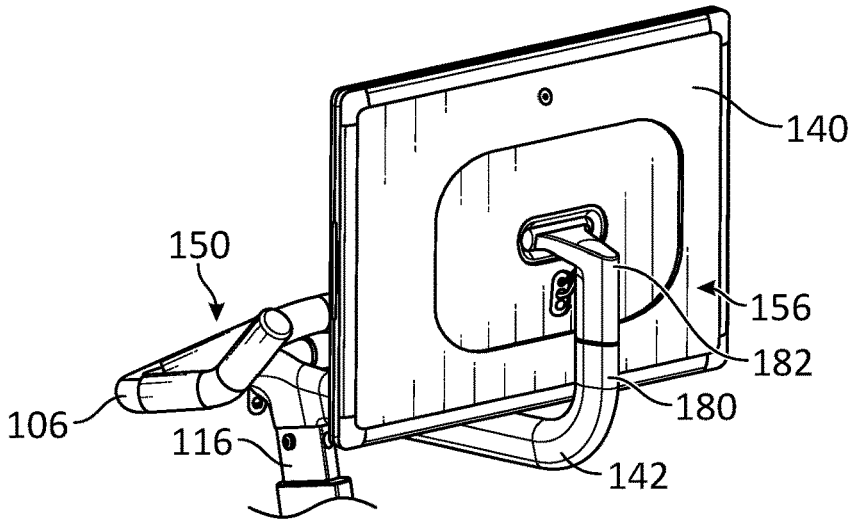
FIG. 12 illustrates a diagram of an exercise device in accordance with an embodiment of the disclosure.

FIG. 10 illustrates a flow diagram of a process 300 of assembling a rotating mechanism operable to reposition a display or other device of an exercise device in a plurality of positions in accordance with an embodiment of the disclosure. Any step, sub-step, sub-process, or block of process 300 may be performed in an order or arrangement different from the embodiments illustrated in FIG. 10. For example, one or more blocks may be omitted from or added to the process 300. Although process 300 is described with reference to the embodiments of FIGS. 1-8, process 300 may be applied to other embodiments.

In Block 302, process 300 may include connecting a stop washer to a pivot of a rotating mechanism. The stop washer and pivot may be similar to the stop washer 220 and pivot 180 described above. For instance, the stop washer may include a tab configured to engage a stop of the pivot. The pivot may include a shaft, with the stop defined on the shaft. In some embodiments, the shaft may include a shelf defined between two shaft portions, and the stop may be defined on or extend from the shelf. In such embodiments, the stop washer may be slid or dropped onto the shaft of the pivot. The stop washer may include a ring body, with the tab extending from the ring body. In such embodiments, the ring body may engage the top of the stop and the tab may engage the shelf of the shaft, such as in a manner as described above. For example, Block 302 may include slidably engaging the ring body of the stop washer with a top of the stop and slidably engaging the tab of the stop washer with the shelf defined on the shaft of the pivot.

In Block 304, process 300 may include rotatably coupling a display mount of the rotating mechanism to the pivot. The display mount may be similar to the display mount 182 described above. For example, the display mount may be configured such that the tab of the stop washer indexes with the display mount so that rotation of the display mount relative to the pivot rotates the stop washer, such as the display mount including a recess in which the tab is received and held. In some embodiments, Block 304 may include rotatably coupling a bushing of the display mount, such as first bushing 230 or second bushing 232 described above, to the shaft of the pivot. The bushing may be formed in or press-fitted into the display mount.

In Block 306, process 300 may include securing the display mount to the pivot. Block 306 may include positioning a plurality of spring washers between the bushing and a nut threaded to the shaft. The spring washers may be stacked, such as in alternating orientations, to achieve a desired spring rate. The nut may be threaded to the shaft against the pressure of the spring washers to provide a desired spring pressure against the display mount to reduce axial slop of the display mount relative to the shaft and still allow rotation of the display mount about the shaft.

In some embodiments, the rotating mechanism may include additional washers, bushings, and spacers. For example, the rotating mechanism may include first and second washers against which first and second bushings of the display mount slides or rotates, similar to the first washer 240 and the second washer 244 described above. In some embodiments, the rotating mechanism may include a sleeve positioned between the stop washer and the second bushing of the display mount, similar to the sleeve 242 described above.

In Block 308, process 300 may include attaching the rotating mechanism to a handlebar assembly of an exercise device. The handlebar assembly and exercise device may be similar to the handlebar assembly 150 and exercise device 100 described above. For example, the exercise device may be an exercise bike or other exercise apparatus designed for cardiovascular and/or strength training of a user. The handlebar assembly may include a handlebar and a support arm extending from the handlebar. In such embodiments, the rotating mechanism may be connected to the support arm of the handlebar assembly. For example, the pivot may include a base with an attachment structure securable to the support arm, such as a portion of the attachment structure received within the support arm in an interference-like fit.

All relative and directional references (including top, bottom, side, front, rear, and so forth) are given by way of example to aid the reader's understanding of the examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

The present disclosure teaches by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. An exercise device comprising:

a handlebar;

a support arm extending from the handlebar;

a rotating mechanism connected to the support arm, at least a portion of the rotating mechanism rotatable relative to the handlebar to pan the rotating mechanism left and right relative to the handlebar;

a display connected to the rotating mechanism, such that panning of the rotating mechanism positions the display in one of a plurality of positions relative to the handlebar; and wherein the rotating mechanism comprises:

a pivot connected to the support arm, the pivot comprising a base, a shaft extending from the base, and a stop;

a display mount connected to the pivot to rotate about the shaft, and a tab indexed to rotate with the display mount and configured to engage the stop of the pivot with rotation of the display mount about the shaft to define at least one stop position of the rotating mechanism.

2. The exercise device of claim 1, wherein:

the shaft of the pivot comprises a shelf; and the tab rides on the shelf of the pivot with rotation of the display mount to engage the stop.

3. The exercise device of claim 1, wherein:

the rotating mechanism comprises a stop washer positioned around the shaft between the pivot and the display mount, the stop washer comprising the tab; and the display mount comprises a recess, the tab received within the recess to index the tab with the display mount such that rotation of the display mount rotates the tab about the shaft.

4. The exercise device of claim 1, wherein:

the shaft comprises a first shaft portion having a first diameter and a second shaft portion having a second diameter different than the first diameter to define the shelf, the display mount comprises a first bushing rotatably connecting the display mount to the first shaft portion;

the display mount comprises a second bushing rotatably connecting the display mount to the second shaft portion; and wherein each of the first bushing and the second bushing comprises a locating tab for indexing the first bushing and the second bushing with the display mount.

5. The exercise device of claim 1, wherein:

the display mount is secured to the shaft via a nut;

a plurality of spring washers is positioned between the display mount and the nut; and at least a portion of the support arm defines a vertical plane, the display mount is configured to rotate about an axis extending within the vertical plane defined by the support arm.

6. The exercise device of claim 1, wherein:

the display is rotatably connected to the rotating mechanism to tilt the display up and down relative to the handlebar;

panning the rotating mechanism relative to the handlebar rotates the display about a vertical axis; and tilting the display relative to the handlebar rotates the display about a horizontal axis perpendicular to the vertical axis.

7. A method of assembling the exercise device of claim 1, the method comprising:

connecting the rotating mechanism to the support arm of the handlebar; and connecting the display to the rotating mechanism.

8. A method of using the exercise device of claim 1, the method comprising:

panning the rotating mechanism to position the display in a first position relative to the handlebar; and panning the rotating mechanism to position the display in a second position relative to the handlebar; and tilting the display to position the display in a third position relative to the handlebar.

9. The method of claim 8, wherein at least one of the first position and the second position is a stop position of the rotating mechanism.

10. The exercise device of claim 1, wherein the exercise device is an exercise bike.

11. A rotating mechanism for rotatably connecting a display to a handlebar of an exercise device, the rotating mechanism comprising:

a pivot comprising a base, a shaft extending from the base, and a stop;

a display mount connected to the pivot to rotate about the shaft; and a tab indexed to rotate with the display mount and configured to engage the stop of the pivot with rotation of the display mount about the shaft to define at least one stop position of the rotating mechanism.

12. The rotating mechanism of claim 11, wherein:

the shaft comprises a shelf;

the stop is defined on the shelf of the shaft; and the tab rides on the shelf with rotation of the display mount about the shaft to engage the stop.

13. The rotating mechanism of claim 12, further comprising a stop washer positioned around the shaft between the shaft and the display mount, the stop washer comprising a ring body and the tab extending from the ring body; and wherein the display mount comprises a recess configured to receive the tab of the stop washer to index the tab with the display mount such that rotation of the display mount rotates the stop washer about the shaft.

14. The rotating mechanism of claim 13, wherein:

the ring body of the stop washer rides on the stop with rotation of the display mount about the shaft;

engagement of the tab with a first side of the stop defines a first stop position of the rotating mechanism; and engagement of the tab with a second side of the stop defines a second stop position of the rotating mechanism.

15. The rotating mechanism of claim 14, wherein:

the shaft comprises a first shaft portion having a first diameter and a second shaft portion having a second diameter different than the first diameter;

the display mount comprises a first bushing rotatably connecting the display mount to the first shaft portion; and the display mount comprises a second bushing rotatably connecting the display mount to the second shaft portion.

16. An exercise device comprising the rotating mechanism of claim 11, the exercise device further comprising:

the handlebar; and the display, the display mounted to the display mount of the rotating mechanism, such that rotation of the display mount about the shaft of the pivot pans the display left and right to position the display in one of a plurality of positions.

17. The exercise device of claim 16, wherein:

the handlebar comprises a pair of bar ends extending towards the rotating mechanism, the pair of bar ends defining a space bounded by the pair of bar ends; and the display is rotatable between the pair of bar ends and at least partially within the space defined between the pair of bar ends.

18. A method of assembling a rotating mechanism operable to reposition a display or other device of an exercise device in a plurality of positions, the method comprising:

connecting a stop washer around a shaft of a pivot of the rotating mechanism, the stop washer comprising a tab configured to engage a stop of the pivot; and rotatably coupling a display mount of the rotating mechanism to the pivot, the tab of the stop washer indexing with the display mount such that rotation of the display mount relative to the pivot rotates the stop washer.

19. The method of claim 18, wherein:

the pivot comprises a shaft, the stop defined on the shaft; and connecting the stop washer to the pivot comprises slidably engaging a ring body of the stop washer with a top of the stop and slidably engaging the tab of the stop washer with a shelf defined on the shaft of the pivot.

20. The method of claim 19, wherein rotatably coupling the display mount to the pivot comprises rotatably coupling a bushing of the display mount to the shaft of the pivot, and wherein the method further comprises securing the display mount to the pivot, wherein securing the display mount to the pivot comprises positioning a plurality of spring washers between the bushing and a nut threaded to the shaft.

* * * * *